United States Patent [19]

Gross et al.

[11] 4,218,306

[45] Aug. 19, 1980

[54] METHOD FOR CATALYTIC CRACKING HEAVY OILS

[75] Inventors: Benjamin Gross; Jong W. Lee, both of Cherry Hill, N.J.

[73] Assignee: Mobil Oil Corporation, New York, N.Y.

[21] Appl. No.: 3,339

[22] Filed: Jan. 15, 1979

[51] Int. Cl.[2] ..... C10G 11/04; B01J 8/24

[52] U.S. Cl. ..... 208/120; 208/72; 208/74; 208/75; 208/78

[58] Field of Search ..... 208/113, 120, 72, 73–78

[56] References Cited

U.S. PATENT DOCUMENTS

| | | | |
|---|---|---|---|
| 3,182,011 | 5/1965 | Friedman | 208/78 |
| 3,617,497 | 11/1971 | Bryson et al. | 208/80 |
| 3,847,793 | 11/1974 | Schwartz et al. | 208/70 |
| 3,856,659 | 12/1974 | Owen | 208/80 |
| 3,886,060 | 5/1975 | Owen | 208/120 |
| 3,894,936 | 7/1975 | Owen | 208/78 |
| 3,896,024 | 7/1975 | Nace | 208/74 |
| 3,904,548 | 9/1975 | Fagan et al. | 252/417 |
| 4,147,617 | 4/1979 | Nace | 208/74 |

*Primary Examiner*—Delbert E. Gantz
*Assistant Examiner*—G. E. Schmitkons
*Attorney, Agent, or Firm*—Charles A. Huggett

[57] ABSTRACT

A riser cracking operation is described for the production of gasoline and distillate material by the combination of cracking fresh gas oil charged to the base of a riser cracking zone for admixture with freshly regenerated catalyst to form a suspension thereof at an elevated cracking temperature, a second hydrocarbon fraction of more difficult cracking characteristics is charged to the suspension rising in the riser cracking zone at a point selected from 10 to about 30 feet above the riser bottom and the riser inlet temperature is restricted to be within the range of 900° to 1000° F.

8 Claims, 3 Drawing Figures

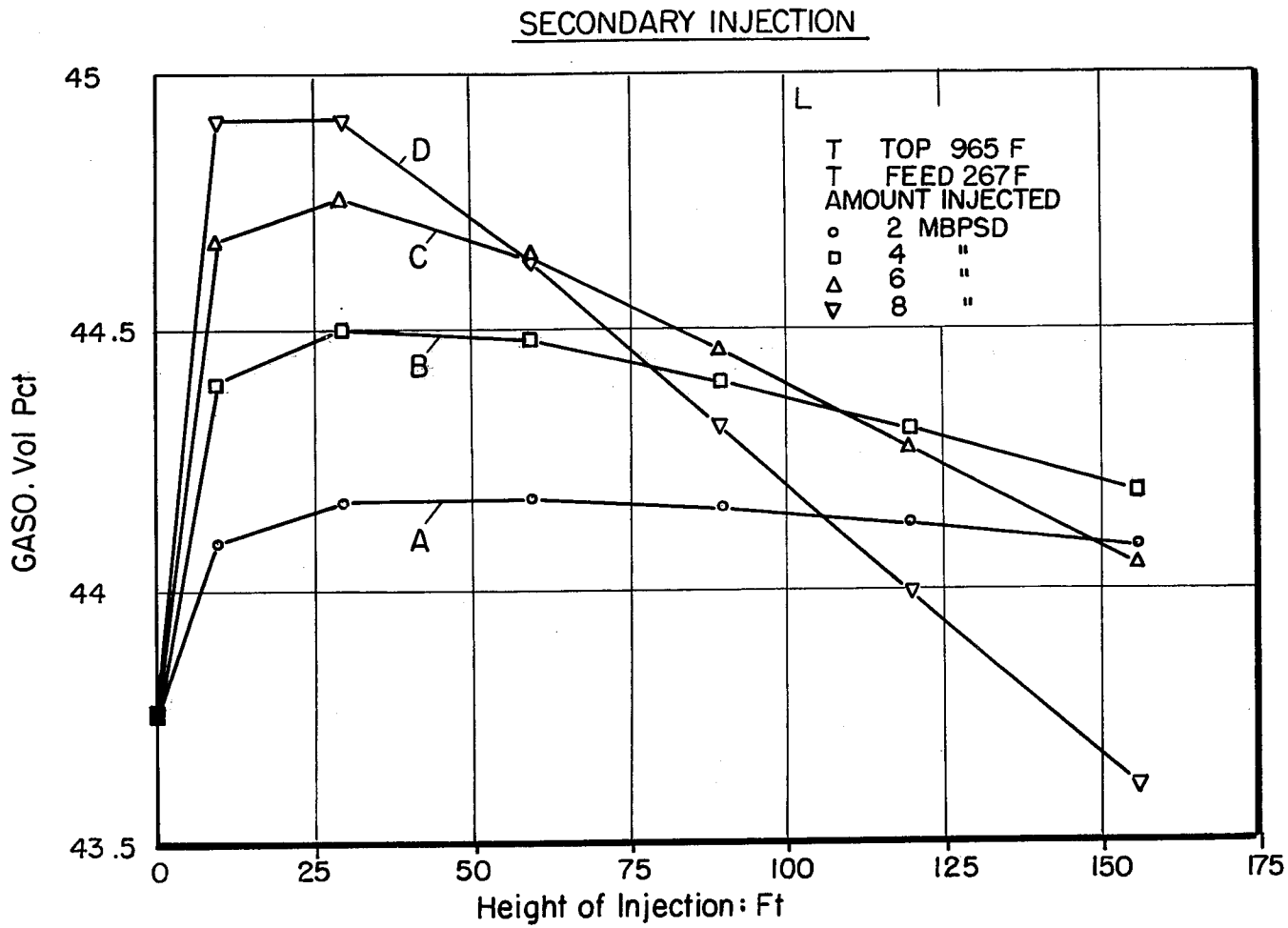
FIG. I

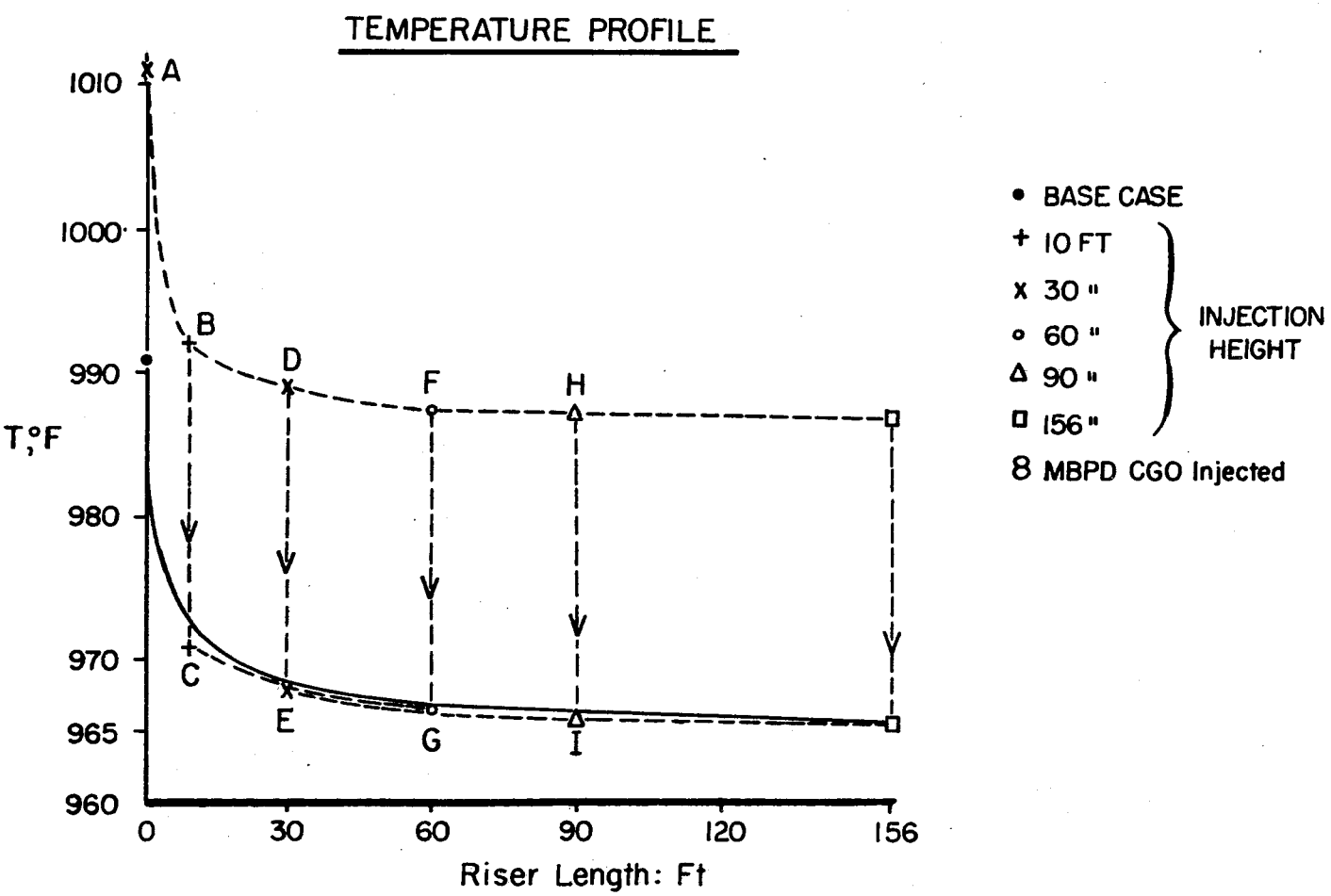
FIG. II

FIG. III
RISER FCC UNIT (Ttop = 985° F)
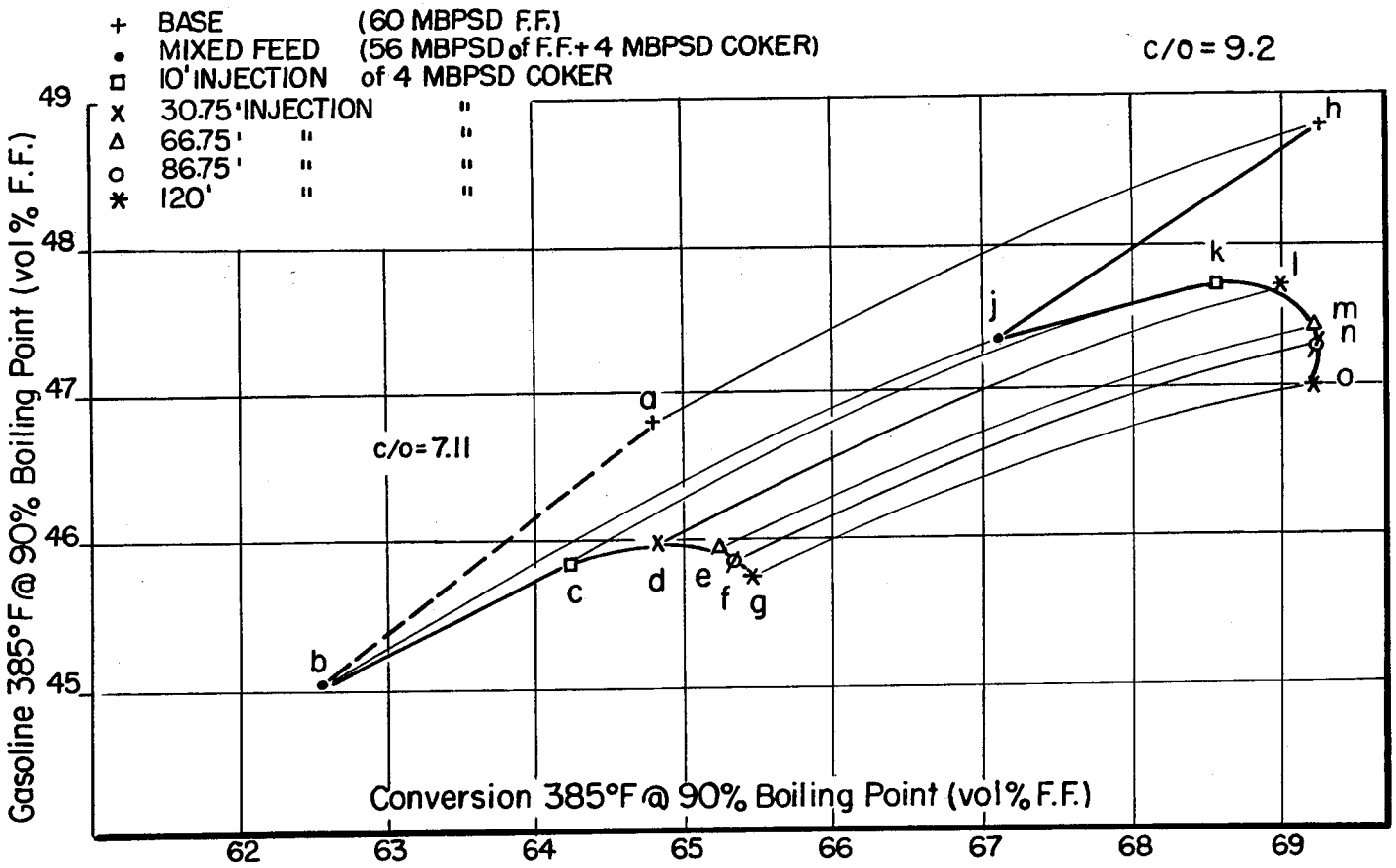

METHOD FOR CATALYTIC CRACKING HEAVY OILS

BACKGROUND OF THE INVENTION

It has been known for a long time that gasoline product of desirable octane can be obtained from selected hydrocarbon fractions by catalytic cracking. However, the yield of such desired gasoline products varies considerably with the composition of the oil feed charged to the cracking operation as well as the severity of the operating conditions employed. It is further known that heavy oils such as residual oils have a large percentage of very refractory components which are more difficult to crack and, in general, cause excessive amounts of coke to be deposited on the catalyst. Furthermore, metal contaminants in a heavy oil feed poison and inactivate the catalyst. Therefore, in the prior art, these undesirable components in the oil feed have been reduced by techniques such as hydrogenation, thermocracking, and/or adsorption on absorbent particle material of little or no cracking activity for the recovery of a more suitable oil feed. In this connection, mild thermal cracking and visbreaking operations, with or without the presence of hydrogen, have been relied upon to produce a more desirable feed material for conversion by catalytic cracking to desired gasoline and/or light fuel oil products.

Residual oil, coker gas oils and other materials high in polynuclear aromatics are known as distress stocks in the petroleum industry. These oils are, therefore, often sold in fuel oil blends or thermally processed, as recited above, to obtain lighter, more desirable components. Residual oils contain large quantities of components, having coke forming tendencies as well as metal contaminants which adversely affect the stability and activity of modern-day cracking catalysts. Coker gas oils high in polynuclear aromatics generally low in metal contaminants also are coke formers and generally considered to be poor cracking feed stocks.

The utilization of relatively high activity catalysts comprising high activity crystalline zeolite cracking catalysts has been responsible for developing refinements in cracking technology or techniques to reduce catalyst inventory systems and to more effectively take advantage of the catalyst activity, selectivity and its operating sensitivity. Reducing the size of equipment and catalyst inventory contributes to an economic advantage readily accepted by the industry.

The following U.S. patents have been considered in the preparation of this application; U.S. Pat. Nos. 3,904,548; 2,994,659; 3,158,562; 3,193,494; 3,896,024; 3,894,936; 3,886,060; 3,856,659; and 3,847,793.

The present invention is concerned with the use of a low catalyst inventory, riser cracking operation using high activity crystalline zeolite catalyst to effect a selective conversion of hydrocarbons varying considerably in chemical and physical composition characteristics. More particularly, the present invention is concerned with disposing of distress stocks such as coker gas oils by fluid cracking.

SUMMARY OF THE INVENTION

The present invention relates to a method and system for converting hydrocarbon feed materials varying considerably in crackability in the presence of high activity crystalline zeolite catalysts. In a more particular aspect, the present invention is concerned with a technique for converting feed materials of different cracking properties or characteristics in a riser cracking system to particularly optimize the conversion of the feed to one of gasoline and distillate or a combination thereof and minimize the yield of a clarified slurry oil (CSO). It is particularly desirable to accomplish this cracking operation without exceeding the coke burning limits of a regeneration operation used in conjunction with the riser cracking operation.

A particular operating expedient of the processing concept of this invention is concerned with identifying and restricting the residence time of various oil fractions brought in contact with an active cracking catalyst and particularly a zeolite catalyst so that one can optimize the yield of gasoline and/or distillate product and, at the same time, restrict the deposition of undesired carbonaceous and nitrogenous products obtained by what is referred to as extended overcracking of a heavy hydrocarbon or residual type material charged to a riser cracking operation.

In a number of commercial fluid cracking operations presently employed, the fresh gas oil hydrocarbon feed and recycled product of cracking or other high boiling recycle products of cracking usually identified as the heavy cycle oil separated from clarified slurry oil, are introduced together for admixture and contact with hot catalyst at the bottom of a riser conversion zone. The combined oil feeds and hot catalyst admixed therewith flow concurrently as a suspension upwardly through the riser conversion zone, thereby deactivating the catalyst with a carbonaceous residue of cracking as the oil charge is converted to gasoline, lower and higher boiling products. In such an operation, it has been found that overcracking of some portions of the oil charged undesirably contributes to the deposited coke load on the catalyst and thus reduces the yield of available gasoline obtainable under more selective conversion conditions. On the other hand, the riser conversion temperature conditions may be restricted by downstream equipment operating conditions. In a particular aspect, the present invention is concerned with converting in a single riser reactor a combination of feed materials, such as recycled products of cracking, coker gas oils, shale oils, and other less desirable oils of varying properties and coke forming characteristics.

It has been found in developing the concepts of the present invention that several factors contribute to the effectiveness of the point of injection of feed materials considered to be of poor cracking characteristics to a riser conversion zone. For example, it has been found that it is possible to maintain a higher inlet temperature for converting fresh feed charged to the riser cracking operation by practicing the processing concepts of this invention to maintain a desired riser top or outlet temperature than is possible when charging the total feed to the base of the riser. This limited high temperature conversion of fresh feed contributes to improving the octane rating of the gasoline obtained. It has also been found that coke deactivation of the catalyst is more desirably controlled following the processing concepts of this invention. In this connection, it has been observed that the injection point of a less desirable secondary feed to a downstream portion of a riser conversion zone will depend on the quantity of the feed charged, the composition of the feed charged, the coke burning restraint of an associated catalyst regenerator and the processing conditions relied upon.

The catalyst employed in the combination operation of this invention is preferably a catalyst comprising a crystalline zeolite of relatively high cracking activity comprising an FAI activity of at least 46 and of a fluidizable particle size. The catalyst is caused to flow suspended in hydrocarbon reactants under elevated temperature cracking conditions through a riser hydrocarbon conversion zone providing a hydrocarbon residence time in contact with catalyst therein in the range of 0.5 up to about 10 seconds and more, usually not above about 8 seconds but at least 2 seconds. Separating hydrocarbon conversion products or gasiform product material from the suspended and entrained catalyst is accomplished substantially immediately following traverse of the riser conversion zone. This immediate separation is most desirable if not essential to minimize overcracking where high temperatures exist to reduce undesired coke deposition. On the other hand, temperatures of at least 985° F. improve the octane rating of the gasoline obtained. During the hydrocarbon conversion step, hydrocarbonaceous material deposits accumulate on the cracking catalyst particles and the particles tend to also entrain hydrocarbon liquid and vapors upon initial separation from vaporous conversion products. Entrained hydrocarbon is thereafter normally removed from the catalyst with stripping gas such as steam in a separate catalyst stripping operation. Hydrocarbon conversion products separated from catalyst particles along with gasiform stripping material are recovered together and passed to a product fractionation or separation step. Stripped catalyst containing deactivating amounts of carbonaceous material often referred to as coke is then passed to a catalyst regeneration zone for removal of deposited coke by burning with oxygen containing regeneration gas thereby heating the catalyst in the regeneration operation to a temperature within the range of 1200° to 1600° F. and more usually not above 1400° F.

The riser hydrocarbon conversion system and method of operation is unique according to this invention for accomplishing the conversion of different hydrocarbon fractions within riser outlet temperature constraints identified below wherein the hydrocarbons vary in coke deposition characteristics and the hydrocarbons vary considerably in boiling range. For example, it is contemplated converting relatively low coke producing gas oils in a lower initial portion of a riser conversion zone at a temperature within the range of 960° F. up to about 1100° F. in the presence of suspended catalyst particles recovered at an elevated temperature from a catalyst regeneration zone. Thereafter, the upwardly flowing gas oil-catalyst suspension following a selected conversion time interval of contact between hydrocarbon feed and catalyst within the range of 0.5 seconds up to about 2, 3 or 4 seconds, depending on the conversion desired, is thereafter contacted with a less desirable hydrocarbon feed fraction such as one of higher coke producing characteristics or a higher aromatic index boiling range material, a heavy recycle oil product of cracking, or a product of thermal cracking such as coker gas oil. Preheating of the gas oil feed or low coke producing oil feed to a selected elevated temperature level up to about 800° F. before contacting hot regenerated catalyst at a temperature within the range of 1200° to 1400° F. is contemplated. This combination of feed preheat and regenerated catalyst temperature may be relied upon in substantial measure to control the extent of conversion achieved in the riser conversion operation. Charging the less desirable and generally higher coke producing hydrocarbon material to a downstream portion of the riser conversion zone with little or no preheat and as temperature recovered from a distillation or separation operation may be used to lower the temperature of the feed-catalyst suspension in the lower portion of the riser conversion zone. Generally the riser conversion zone outlet temperature may be restricted to within the range of 850° F. to 1050° F. or as hereinafter provided.

The riser conversion of different feeds with suspended catalyst according to this invention is unique in several respects. That is, in a riser reactor conversion operation of restricted outlet temperature as herein provided, the yield of selected and desired product may be varied. One or more of the hydrocarbon conversion reactions herein identified may be effected in the riser zone designed to be of constant diameter or the riser reactor may be designed to vary in diameter in various sections thereof and be of a selected length in any one section thereof to provide desired conditions in severity of operation. That is, conversion of the fresh feed such as a gas oil feed or another low coke producing material charged to the riser is accomplished in a lower bottom and/or a more restricted diameter portion of the riser providing relatively rapid acceleration of the highest temperature suspension initially formed therein and retained for a limited time period particularly providing a selective conversion desired to gasoline before contact in a more downstream portion of the riser with a higher coke producing feed under decreasing temperatures. The initially formed suspension may also be contacted with the secondary coke producing hydrocarbon charge material in a downstream portion of the riser of the same diameter or in a transition zone between the smaller and larger diameter portions of the riser and under temperature conversion conditions supporting riser outlet temperatures herein defined. The secondary feed varying in properties from the initial hydrocarbon charge such as by a higher coke producing hydrocarbon charge may be added to the riser adjacent to or in an elongated and generally diverging or transition section to the larger diameter section of the riser conversion zone. It is contemplated in yet another embodiment of charging additional regenerated catalyst to the riser at an elevated temperature to provide a higher catalyst to oil suspension and to effect conversion of the combined feeds to the riser within the riser outlet temperature constraints herein identified. Generally, the temperature of the suspension in the bottom portion of the riser will be from 50 to 150 degrees higher than the herein identified riser outlet temperature in the range of about 900° F. to about 1100° F. The suspension temperature will be lowered primarily due to the endothermic heat of conversion of the hydrocarbon feeds. The lower suspension temperature following contact with the introduced secondary hydrocarbon charge material will normally require a longer residence contact time with catalyst for effecting a desired conversion thereof in the remaining downstream portion of the riser. A temperature differential ($\Delta T$) in the riser downstream of the secondary feed injection point within the range of 25 to 100 degrees is contemplated. However this temperature differential will normally be in the range of 50 to 55 degrees $\Delta T$.

In the riser conversion arrangement of this invention, it is also contemplated improving naphtha boiling hydrocarbons octane in a very bottom portion of the riser with freshly regenerated catalyst at its highest activity and temperature, effecting conversion of fresh gas oil feed of relatively low coking characteristics downstream of said naphtha upgrading and effecting conversion of a residual oil, a heavy cycle oil product of catalytic cracking or a coker gas oil in a further downstream portion of the riser as herein particularly discussed. It is also contemplated effecting conversion of a low aromatic index gas oil fraction to gasoline boiling products initially in the riser under relatively high temperature conditions of at least 1000° F. and charging a higher aromatic index gas oil as the secondary feed to a downstream portion of the riser.

In yet another embodiment, a light gaseous hydrocarbon fraction charged to the bottom of the riser comprising $C_5$ and lower boiling hydrocarbons may be used to form a high temperature suspension of at least 1000° F. which suspension is thereafter contacted with a higher boiling atmospheric and/or vacuum gas oil before contact with a heavy residual oil, coker gas oil, clarified slurry oil from the FCC main column or an FCC main column bottoms fraction under the riser outlet temperature constraints herein identified. In any of the above arrangements, dispersal of the light and heavy hydrocarbons to form the upflowing suspension can be facilitated by using a plurality of oil injection nozzle in a bottom cross-sectional area of the riser or about the riser circumference particularly at the point of secondary injection.

DISCUSSION OF SPECIFIC EMBODIMENTS

The charge stock properties, Table 1, used in developing the operating concepts of this invention were estimated from various available sources.

Table 1

| FCC Feedstock Properties | Fresh Feed | Coker Heavy Gas Oil | Chemical Reject |
|---|---|---|---|
| API | 27.2 | 23 | 13.6 |
| Basic Nitrogen, ppm | 161 | 700 | 24 |
| CCR, % wt | 0.093 | 0.42 | 3.0 |
| 650−, % wt | 39.1 | | 82.3 |
| Paraffins, % wt | 27.1 | | 16.3 |
| Naphthenes, % wt | 43.8 | | 9.9 |
| $C_A$, % wt | 15.7 | | 48.5 |
| Sulfur, % wt | 0.61 | | 1.10 |
| Molecular Weight | 238 | | 200 |
| 650+, % wt | 60.9 | 100 | 17.7 |
| Paraffins, % wt | 22.7 | 18.7 | 6.5 |
| Naphthenes, % wt | 36.2 | 17.4 | 4.2 |
| $C_A$, % wt | 17.6 | 30.6 | 61.4 |
| Sulfur, % wt | 0.99 | 1.78 | 1.51 |
| Molecular Weight | 387 | 330 | 404 |

$C_A$ - aromatic carbon ring content; comprises substantial polynuclear aromatics The effect of the secondary feed injection of each feed stream was separately investigated so that the interactions, if any, between the various secondary feed streams could be uncoupled. To accomplish this, a base case was run for each secondary feed stream identified above in which the total feed to the base of the riser consisted of the fresh feed and the particular secondary feed stream to be injected. Each base case operation was then compared with the corresponding downstream secondary injection case, keeping the amount of the secondary hydrocarbon feed stream injected, the riser top outlet temperature, and the total hydrocarbon feed rate constant. Comparison data for these combination operations is presented in Table 2. It will be observed that the yield pattern varies significantly with the type of feed used for the secondary injection feed.

Table 2

DETAILED YIELD COMPARISONS AT CONSTANT FEED RATE AND RISER TOP TEMPERATURE

| | FF | | CGO | | MCCR | | Recycle | |
|---|---|---|---|---|---|---|---|---|
| | Base | Secondary Injection | Base | Secondary Injection | Base | Secondary Injection | Base | Secondary Injection |
| Operating Conditions | | | | | | | | |
| Primary Feed, MBPSD | 89.44 FF | 86 FF | 86 FF +3.349 CGO | 86 FF | 86 FF +3.145 MCCR | 86 FF | 86 FF +3.0 Recycle | 86 FF |
| Secondary Feed, MBPSD. (Eq. to 4% wt) | | 3.44 FF | | 3.349 CGO | | 3.145 MCCR | | 3.0 Recycle |
| Combined Feed Ratio, wt | 1.04 | 1.04 | 1.04 | 1.04 | 1.04 | 1.04 | 1.08 | 1.08 |
| Riser Top Temperature, °F. | 945 | 945 | 945 | 945 | 945 | 945 | 945 | 945 |
| Oil to Riser Temperature, °F. | 543 | 543 | 543 | 543 | 543 | 543 | 543 | 543 |
| Regen. Temperature, °F. | 1270.0 | 1269.8 | 1275.0 | 1274.4 | 1284.2 | 1284.2 | 1278.5 | 1278.0 |
| Riser Mix Temperature, °F. | 996.0 | 1002.4 | 996.1 | 1002.8 | 996.5 | 1003.3 | 995.3 | 1002.3 |
| Height of Sec. Injection, ft | | 18 | | 18 | | 18 | | 18 |
| Catalyst Activity (FAI) | 69 | 69 | 69 | 69 | 69 | 69 | 69 | 69 |
| Carbon on Regen., % wt | 0.16 | 0.16 | 0.16 | 0.16 | 0.16 | 0.16 | 0.16 | 0.16 |
| Carbon on Spent, % wt | 0.93 | 0.93 | 0.95 | 0.95 | 0.97 | 0.97 | 0.96 | 0.96 |
| Reactor Cat. Res. Time, sec | 15.03 | 15.02 | 15.29 | 15.16 | 15.35 | 15.32 | 15.52 | 15.36 |
| Total Coke Make, M lb/hr | 59.54 | 59.36 | 59.48 | 59.37 | 59.48 | 59.34 | 59.18 | 59.14 |
| LFO 90% Point, °F. | 630 | 630 | 630 | 630 | 630 | 630 | 613 | 620 |
| Total Feed Rate, lb/hr | 1,206,923 | | 1,206,923 | | 1,206,923 | | 1,206,923 | |
| Yields, % Total Feed | | | | | | | | |
| Conversion, 385 @ 90% vol | 75.32 | 75.38 | 73.97 | 74.62 | 73.54 | 73.59 | 75.17 | 75.74 |
| CSO, % vol | 2.85 | 2.86 | 2.85 | 2.85 | 2.86 | 2.86 | 2.94 | 2.92 |
| HFO, % vol | 0.38 | 0.38 | 1.05 | 1.09 | 0.57 | 0.46 | 0 | 0 |
| LFO, % vol | 21.45 | 21.37 | 22.14 | 21.45 | 23.03 | 23.09 | 21.90 | 21.34 |
| $C_5$+ Gasoline, % vol | 56.33 | 56.00 | 55.49 | 55.53 | 55.05 | 54.77 | 56.26 | 56.41 |
| Total $C_4$'s, % vol | 16.44 | 16.74 | 15.71 | 16.26 | 15.77 | 16.02 | 16.10 | 16.49 |
| Total $C_3$'s, % vol | 11.25 | 11.50 | 10.79 | 11.16 | 10.77 | 10.96 | 10.97 | 11.19 |
| $C_2$−, % wt | 2.89 | 2.94 | 2.89 | 2.95 | 2.90 | 2.95 | 3.02 | 3.05 |
| Coke | 5.12 | 5.11 | 5.12 | 5.11 | 5.12 | 5.11 | 5.30 | 5.29 |
| ΔGasoline, BBL/day | −298 | | 34 | | −248 | | 123 | |
| ΔLFO, BBL/day | −71 | | −619 | | 57 | | −478 | |
| ΔCSO + HFO, BBL/day | 16 | | 35 | | −104 | | −14 | |

Table 2-continued

| DETAILED YIELD COMPARISONS AT CONSTANT FEED RATE AND RISER TOP TEMPERATURE | FF | | CGO | | MCCR | | Recycle | |
|---|---|---|---|---|---|---|---|---|
| | Base | Secondary Injection | Base | Secondary Injection | Base | Secondary Injection | Base | Secondary Injection |
| $\Delta C_4$'s, BBL/day | 272 | | 493 | | 228 | | 330 | |
| $\Delta C_3$'s, BBL/day | 220 | | 333 | | 175 | | 189 | |

It will be observed from the data of Table 2 that different feed compositions give different results, for example, the injection of coker gas oil or a recycle product mixed with gas oil at the same level, are not necessarily optimum, results in gasoline increases of about 34 and about 123 BBL/day respectively. Light fuel oil product obtained under this mixed feed injection decreases in both cases, 619 BBL/day for the charged coker gas oil and only 478 BBL/day for the charged recycle. Also, the light gas produced is significantly higher for both the coker and recycle materials mixed feeds due to the increased conversions. For the coker gas oil charge, the light gas increase is 826 BBL/day of $C_3$ - $C_4$ hydrocarbons. For the recycle feed charged, the $C_3$ - $C_4$ hydrocarbons increased by 519 BBL/day.

It will be further observed that the yield pattern for the secondary injection of fresh feed and the chemical reject feed are both significantly poorer than that obtained in the above two cases for coker gas oil and recycle material. When injecting some fresh feed as a secondary feed to a downstream portion of the riser, the gasoline yield drops by about 298 BBL/day and the light fuel oil yield drops by 71 BBL/day. There is however an increase of $C_3$ - $C_4$ hydrocarbons of about 492 BBL/day. For the chemical reject injection mode, the gasoline yield drops by 248 BBL/day, but the light fuel oil (LFO) yield increases by 57 BBL/day. In this operating mode, the $C_3$ - $C_4$ yields increased by about 403 BBL/day.

The data of Table 2 above discussed clearly show for a preselected secondary fuel injection point and the amount thereof charged, a change in product selectivity is obtained by this charging of the different secondary hydrocarbon feeds. By secondary feed charging is meant, introducing a secondary hydrocarbon feed of different chemical and physical properties than a fresh gas oil feed to a downstream portion of the riser conversion zone. A fresh lower coke producing atmospheric gas oil feed is charged to a lower bottom portion of the riser conversion zone. The data obtained and discussed above clearly show the difference in product distribution obtained by injecting a coker gas oil and heavy recycle product of catalytic cracking at the same level to a riser downstream of the fresh gas oil feed to the bottom of the riser. This however is not necessarily the optimum injection point for reasons discussed hereinafter. The secondary feed is usually one of higher coke producing characteristics than the fresh gas oil feed herein identified and charged to the bottom portion of the riser.

The secondary feed injection concept of this invention to convert particularly high coking feeds was investigated to also identify the height above the bottom of the riser at which the secondary feed should be charged to obtain a desired riser outlet temperature and conversion thereof. That is, in a riser conversion operation charging an atmospheric and/or vacuum fresh gas oil feed to the bottom of a riser conversion zone and a coker gas oil to a downstream portion of the riser conversion zone, the data obtained were graphically represented in FIGS. I, II and III.

FIG. I graphically shows the effect of secondary feed injection height and volume thereof injected on gasoline yields when retaining a riser outlet temperature of 965° F.

FIG. II graphically shows the effect on riser temperature profile when charging a given quantity of secondary feed to various vertical heights of the riser.

FIG. III graphically shows the effect of secondary feed injection height to the riser on gasoline yield and conversion for two different catalyst to oil ratios when restricting the riser outlet temperature to 985° F.

Referring now to FIG. I, a hydrocarbon feed comprising gas oil and identified in Table 1 charged to the bottom of a riser conversion zone forms a rising hydrocarbon-catalyst suspension. To this suspension is charged different volumes of coker gas oil. The level of secondary injection of the coker gas oil substantially altered the yield of gasoline obtained as shown when restricting the riser top temperature to about 965° F. Also, the amount of secondary feed injected substantially influenced the product selectivity and yield. For example, when charging about 2000 BPSD of coker gas oil (the lower curve A) at a temperature of about 267° F. to the suspension in the riser, the gasoline volume percent yield achieves a maximum of not more than about 44.25 vol. percent, or less, no matter at what level 25, 50 and 75 feet charged to the riser. When charging about 4000 BPSD of the coker gas oil curve B, the yield of gasoline achieves a maximum when the oil was charged at about the 25 foot level of the riser. At higher charge levels, the gasoline yield was reduced. Charging 6000 BPSD of the coker gas oil (curve C) also shows maximizing the gasoline yield when charging the secondary feed at the 25 foot level. On the other hand, charging 8000 BPSD of the coker gas oil produced maximum gasoline yield at a charge level to the riser in the range of about 10 to 25 feet.

Referring now to FIG. II, the riser temperature profile obtained is identified when charging 8000 BPSD of a heavy coker gas oil. In a base case for comparison wherein all of the feed is charged to the bottom of the riser as represented by the solid curve of the figure, an initial feed-catalyst suspension temperature of about 990° F. or slightly higher rapidly dropped off to below 970° F. at the 30 foot level of the riser and gradually decreased in temperature above that level to the 156 foot riser level at the top of the riser maintained at 965° F. When charging the coker gas oil as a secondary feed (10 feet above the riser bottom) and downstream of the fresh feed-catalyst suspension formed at a temperature of 1010° F., the riser temperature profile follows the curve ABC and adjusts to a temperature of about 970° F. at point C. The temperature profile thereafter follows substantially the solid line temperature profile as shown and briefly discussed above for a riser outlet temperature of about 965° F. Charging the coker gas oil at the 30 foot level of the riser, a temperature profile of ABDE is obtained, with point E being relatively close to the solid line temperature profile of the base case. Charging the coker gas oil at the 60 foot level of the riser produces the temperature profile ABDFG and charging it at the 90 foot level produces the temperature profile ABDFHI.

Thus, the graphical representation of data comprising FIGS. I and II clearly show the desirability of charging secondary feed such as coker gas oil and other less desirable coke producing oil fractions to a riser conversion zone between the 10 and 25 foot level above the charged fresh feed (gas oil) to the riser bottom. In addition, the yield of gasoline can be substantially improved by maintaining the temperature profile of the riser for a riser outlet temperature of 965° F. in accordance with that particularly identified by FIG. I. It must also be observed from FIG. I that as the volume of the secondary feed is increased, the level of injection of the secondary feed becomes more restricted.

It is recognized from the data and information herein presented that the secondary feeds boiling above about 650° F. and identified above can be processed under selected condition with advantage in combination with an atmospheric gas oil feed to high yields of gasoline boiling product following the operating techniques herein described. On the other hand, some secondary hydrocarbon materials generally lower boiling than about 650° F., such as the chemical reject material of Table 1, do not contribute to improved gasoline product yield as do other higher coke producing materials.

The graphic arrangement of FIG. III dramatically shows an improvement in gasoline yield and conversion obtainable by following the processing concepts of this invention when restricting the riser outlet temperature to 985° F. That is, in the arrangement of FIG. III, data points for two different catalyst to oil ratios identified and connected by a dotted line for one and a solid line for the other particularly show the conversion differences for the charged feed arrangements identified on the graph. The data points identified on the graph for different feed charged arrangement and connected by the dotted line to the left of the graph were obtained with a catalyst to oil ratio of 7.11 and the data points connected by a solid line to the right of the graph are for a catalyst to oil ratio of 9.20. The data (+) point (a) on the upper curve charging 60 MBPSD of fresh gas oil feed only to the base of the riser identifies the volume percent of gasoline obtained as about 46.8, at a conversion of about 64.8 when using a catalyst to oil ratio of 7.11 to crack the fresh gas oil feed and maintain a riser discharge temperature restricted to 985° F. Data point (b) represents the results obtainable when charging fresh gas oil mixed with 4 M BBL of coker oil identified in Table 1 to the bottom of a riser conversion zone under conditions to limit the riser outlet temperature to 985° F. Data point (b) for the 7.11 catalyst to oil ratio operation shows a loss in gasoline yield to about 45.0 vol. percent at about 62.5 vol. percent conversion. Data point (c) for the 7.11 catalyst to oil ratio operation charging 4 MBPSD coker gas oil 10 feet up the riser provided improvement in gasoline yield of about 45.8 at 64.25 conversion. Data point (d) shows gasoline yield of about 46 at 64.8 conversion. Data point (e) provides slightly less gasoline 45.9 at 65.25 conversion, data point (f) shows 45.85 gasoline at 65.35 conversion and data point (g) shows gasoline yield of 45.75 at 65.45 conversion level. Thus when operating with a catalyst to oil ratio of about 7 and maintaining a riser outlet temperature restricted to 985° F., charging the secondary feed to the riser at the 30.75 foot level appears optimum.

More significant, however, is the change occurring in gasoline yield and conversion when processing under the conditions represented by data points h, j, k, l, m, n and o of the solid line curve. For example, for the higher catalyst to oil ratio of 9.2, a significant advantage in gasoline yield for any given level of conversion is shown between the data points connected by h, j, k, l, m, n and o and the data points connected by a, b, c, d, e, f and g. For example data point (h) shows gasoline yield of 48.8 for 69.25 conversion level; data point (j) shows gasoline yield of 47.35 for 67.1 conversion; data point (k) shows gasoline yield of 47.7 for 68.6 conversion; data point (h) shows 47.7 gasoline at about 69 conversion; data point (m) shows gasoline of about 47.4 at 69.2 conversion. Data points (n) and (o) show gasoline yields of 47.3 and 47.0 respectively for a conversion level of about 69.2. Thus data point (k) for a 9.2 catalyst/oil ratio shows substantially improved result when charging the coker gas oil at the 10 foot level above the fresh feed inlet at the riser bottom. In the 7.11 catalyst to oil operation the gasoline yield jumped from about 45.0 to about 46.0 vol. percent between data points (b) and (d) and for the 9.2 catalyst to oil operation, the gasoline yield went from about 47.35 data point (j) to about 47.75 vol. percent for data points (k) and (l). However, charging the coker oil farther up the riser, as represented by data points e, f and g, provided a reversed trend in gasoline yield as shown by the dotted line curve. A similar trend is noted for data points m, n and o. Thus, it is undeniably clear from the graphic representation of FIG. III that significant variations in gasoline yield and conversion can be had depending on the catalyst to oil ratio employed and the level at which the secondary feed is injected when restricting the riser outlet temperature to 985° F. More importantly, however, is the finding that the combination operation of this invention permits processing hydrocarbon oils known as distress stocks or stocks of high coking characteristics with a more desirable cracking stock such as a fresh gas oil feed to advantage and without undesirably influencing the yield of desired gasoline boiling range product. Furthermore depending upon the riser outlet temperature selected as herein provided, significant improvement in light fuel oil product known as distillate and a reduction in gaseous product yield can also be realized.

It will be recognized by those skilled in the art that numerous variations may be made on the processing concepts of this invention without departing from the spirit of the invention.

The processing concepts of this invention are concerned with restricting a riser outlet cracking temperature within the range of about 900° F. to about 1000° F. and more particularly within the range of about 950° to about 985° F. The operating constraints identified herein appear somewhat arbitrary at first blush but are important to the operating world of today for modifying existing refineries wherein temperature restriction limits are associated with downstream equipment such as coolers, the main column fractionating tower downstream of the cracking unit or a constraint based on an associated regeneration zone for removing deposited coke of cracking by burning.

The data of the figures presented permit one to draw significant conclusions with respect to the operation described and related operations. For example, referring to FIG. I wherein a riser top temperature constraint of 965° F. is identified, it is found that the processing combination involving secondary injection obtains best results with respect to gasoline yield-conversion relationship by charging the second feed to the riser about the 10 foot level. This is believed to be unusual and also unpredictable. Also, when the riser outlet temperature is raised to 985° F., the level of secondary injection (coker gas oil injection) for gasoline yield-conversion relationship is preferably about the 10 foot level for the higher catalyst to oil ratio operation. In the operation of FIG. III, however, the higher catalyst to oil ratio at the riser outlet temperature of 985° F. permits achieving a much higher gasoline yield than obtained at a lower catalyst to oil ratio or at a riser outlet temperature of 965° F., FIG. I, while disposing of undesirable charge materials such as coker gas oil. On the other hand, when operating according to FIG. 1 it is observed that charging 6 MBPSD of secondary feed or less provides best results at the 25 foot level. Thus, depending upon downstream processing equipment temperature constraints to handle a given volume of product passed therethrough, the riser cracking operation comprising secondary injection can be varied over a considerable catalyst to oil ratio, volume of secondary charge and riser outlet temperature constraint to produce high yields of gasoline during disposal of difficult charge stocks such as coker gas oil and other difficult materials to crack because of coking tendencies.

It is significant to note that, as the catalyst to oil ratio is increased according to FIG. III that a coker gas oil charge of 4 MBPSD can be charged to the riser between the 10 and 30.75 foot level for the same gasoline yield for slightly different conversions. However it is clear from these data that charging the coker gas oil with the fresh feed to the base of the riser produced inferior results. Therefore applicants concluded that the charging of residual oils, coker gas oils and heavy recycle products of cracking as secondary charge materials to a riser cracking operation restricted to an outlet temperature in the range of 950° F. to about 1000° F. can be accomplished with advantage with respect to gasoline yield distillate product and light gaseous products by charging the secondary feed preferably about the 10 foot level and up to about the 25 foot level of the riser reactor above the fresh feed inlet without exceeding undesired levels of conversion or catalyst to oil ratios. More particularly, it is preferred that the riser outlet temperature be at least about 965° F. but not above 1000° F. for producing high yields of gasoline. Restricting the riser outlet temperature to about 965° F. is more desirable when optimizing the yield of distillate at the expense of gasoline production. The operating conditions of FIG. III, at least with respect to the catalyst to oil ratios employed, represent a normal type of operation at about 7 catalyst to oil ratio and slightly higher than normal with the 9.2 catalyst to oil ratio operation.

Effecting the operation herein identified at the higher catalyst to oil ratio is beneficial to the extent that the deposition of carbonaceous material is over a larger volume of catalyst to be regenerated, more catalyst is available to absorb the heat of regeneration and recycle of the larger volume of regenerated catalyst for conversion of fresh feed can operate to reduce fresh feed preheat to maintain a given or desired riser outlet temperature as herein preferred.

Having thus generally described the method and concepts of the invention and discussed specific embodiments going to the essence thereof, it is to be understood that no undue restrictions are to be imposed by reasons thereof except as defined by the following claims.

We claim:

1. In a riser cracking operation processing hydrocarbon feeds of different cracking characteristics, the method for producing high yields of gasoline boiling product which comprises, passing a hydrocarbon feed comprising fresh atmospheric gas oil admixed with freshly regenerated crystalline zeolite catalyst as a suspension at an elevated cracking temperature upwardly through an initial portion of a riser conversion zone, for a contact time selected to particularly produce one of gasoline and distillate boiling product, charging a second high coke producing hydrocarbon fraction selected from the group consisting of gas oil products of thermal cracking, heavy residual oil products of catalytic cracking and distress stocks comprising substantial amounts of polynuclear aromatics into said upwardly flowing suspension at a level from 10 to about 30 feet above the atmospheric gas oil charge level under conditions and at a temperature maintaining a riser conversion zone outlet temperature within the range of 900° F. to 1100° F., and recovering an improved yield of gasoline product over that obtainable at the same outlet temperature by charging all of the hydrocarbon feeds to the bottom of the riser conversion zone.

2. The cracking operation of claim 1 wherein the initially formed high temperature suspension is retained under conversion conditions for a hydrocarbon contact time within the range of 0.5 to 3 seconds before charging the second hydrocarbon fraction.

3. The cracking operation of claim 1 wherein the second hydrocarbon fraction comprises a distress stock of difficult cracking characteristics.

4. The cracking operation of claim 1 wherein the temperature differential between the bottom and top of the riser is within the range of 25 to 150 degrees and the riser outlet temperature is below 1000° F.

5. The cracking operation of claim 1 wherein the second hydrocarbon fraction comprises a coker gas oil.

6. The cracking operation of claim 1 wherein the riser outlet temperature is selected between about 965° F. and about 985° F.

7. The cracking operation of claim 1 wherein the catalyst to oil ratio of the hydrocarbon suspension above the second hydrocarbon feed inlet is at least about 7 and more preferably at least about 9.

8. The cracking operation of claim 1 wherein the second hydrocarbon fraction is charged to the riser cracking zone from 10 to 25 feet above the bottom of the riser fresh feed inlet.

* * * * *